US008907648B2

(12) United States Patent
Ho et al.

(10) Patent No.: US 8,907,648 B2
(45) Date of Patent: Dec. 9, 2014

(54) POWER FACTOR CORRECTION CIRCUIT, CONTROL CIRCUIT THEREFOR AND METHOD FOR DRIVING LOAD CIRCUIT THROUGH POWER FACTOR CORRECTION

(75) Inventors: Jyun-Che Ho, Xikou Township, Chiayi County (TW); Chien-Fu Tang, Hsinchu (TW); Isaac Y. Chen, Zhubei (TW); Shao-Hung Lu, Taoyuan (TW); Tzu-Chen Lin, Zhubei (TW)

(73) Assignee: Richtek Technology Corporation, Chupei, Hsin-Chu (TW)

( * ) Notice: Subject to any disclaimer, the term of this patent is extended or adjusted under 35 U.S.C. 154(b) by 352 days.

(21) Appl. No.: 13/478,015

(22) Filed: May 22, 2012

(65) Prior Publication Data

US 2012/0306459 A1 Dec. 6, 2012

(30) Foreign Application Priority Data

Jun. 2, 2011 (TW) ..... 100119425 A

(51) Int. Cl.
*G05F 1/00* (2006.01)
*H05B 33/08* (2006.01)

(52) U.S. Cl.
CPC ..... *H05B 33/0818* (2013.01)
USPC ..... 323/284; 323/285

(58) Field of Classification Search
CPC ..... G05F 1/70; G05F 1/565; G05F 1/575
USPC ..... 323/222, 282, 284, 285
See application file for complete search history.

(56) References Cited

U.S. PATENT DOCUMENTS

| | | | | |
|---|---|---|---|---|
| 7,605,574 | B2 * | 10/2009 | Dearn et al. | 323/284 |
| 8,283,907 | B1 * | 10/2012 | Jayaraj | 323/282 |
| 2011/0037414 | A1 | 2/2011 | Wang et al. | |
| 2011/0141631 | A1 * | 6/2011 | Yabuzaki et al. | 361/18 |
| 2014/0097808 | A1 * | 4/2014 | Clark et al. | 323/208 |

* cited by examiner

*Primary Examiner* — Matthew Nguyen
(74) *Attorney, Agent, or Firm* — Tung & Associates

(57) ABSTRACT

The present invention discloses a power factor correction circuit, a control circuit therefor and a method for driving a power factor correction circuit. The power factor correction circuit receives rectified power obtained by rectifying AC power, and corrects the power factor thereof. The power factor correction circuit includes an inductor, and it generates a reference signal as a limit for the inductor current. The reference signal is proportional to Comp/Vin, wherein Comp is a signal relating to a feedback signal, and Vin is a voltage signal relating to the AC power or the rectified power.

12 Claims, 6 Drawing Sheets

POWER FACTOR CORRECTION CIRCUIT, CONTROL CIRCUIT THEREFOR AND METHOD FOR DRIVING LOAD CIRCUIT THROUGH POWER FACTOR CORRECTION

CROSS REFERENCE

The present invention claims priority to TW 100119425, filed on Jun. 2, 2011.

BACKGROUND OF THE INVENTION

1. Field of Invention

The present invention relates to a power factor correction circuit, a control circuit for a power factor correction circuit, and a method for driving a load circuit through power factor correction; in particular, the present invention relates to such circuits and method that can keep an output current under an upper limit by a chop control method.

2. Description of Related Art

FIG. 1 shows an LED (light emitting diode) driver circuit disclosed in US 2011/0037414, which supplies power with corrected power factor to an LED circuit. The driver circuit includes a flyback power factor correction (PFC) converter 301, a harmonic filter 303 and a control circuit 305. The flyback PFC converter 301 operates according to a pulse width modulation (PWM) signal, and it converts AC power to a pulse current. The harmonic filter 303 is coupled to the flyback PFC converter 301 and the LED circuit to receive the pulse current and filter its high frequency part. The control circuit 305 is coupled to the flyback PFC converter 301 and the harmonic filter 303, for generating a PWM signal according to the AC power and the pulse current, and reducing a peak-to-average ratio (PAR) of the pulse current. Because this arrangement reduces the current PAR, it does not require using an electrolytic capacitor with high capacitance, thus reducing cost and extending the life time of LEDs. However, this prior art has a drawback that it requires complicated control.

FIG. 2A shows prior art waveforms of an inductor current 71, a current peak envelope 72, and an average current 73 at a primary side of a prior art PFC converter. The voltage waveform (not shown) is in phase with the current peak. Because the current PAR is large, an electrolytic capacitor with very large capacitance is required.

FIG. 2B shows a PFC converter disclosed in US 2010/0014326. It has a harmonic regulation unit which can generate an inductor current containing third harmonic. As the third harmonic is added, the waveforms of the inductor current 74, a current peak envelope 75 and an average current average 76 are as shown in the figure, wherein the current PAR is reduced so it does not require using an electrolytic capacitor with large capacitance. However, this prior art has a drawback that the voltage peak deviates from the current peak, so it has a poor power factor.

To overcome the drawbacks of the above prior art, the present invention proposes a power factor correction circuit, a control circuit for a power factor correction circuit, and a method for driving a load circuit through power factor correction, which can reduce output voltage ripples and extend the life time of LEDs, with simple circuitry.

SUMMARY OF THE INVENTION

An objective of the present invention is to provide a power factor correction circuit.

Another objective of the present invention is to provide a control circuit for a power factor correction circuit.

Further another objective of the present invention is to provide a control circuit for a method for driving load circuit through power factor.

To achieve the foregoing objectives, in one perspective of the present invention, it provides a power factor correction circuit receiving rectified power obtained by rectifying AC power and correcting the power factor of the rectified power, the power factor correction circuit comprising: an inductor coupled to the rectified power; a power switch operating to control a current of the inductor (inductor current); and a control circuit generating a feedback-related signal according to a feedback signal, and generating an operation signal to control the power switch according to the feedback-related signal, a current sensing signal relating to the inductor current, and a first reference signal, wherein the control circuit generates a second reference signal according to the first reference signal to determine an upper limit of the inductor current, and the control circuit compares the current sensing signal with the second reference signal; when the current sensing signal is not lower than the second reference signal, the power switch is turned off so that the inductor current is kept not higher than the upper limit.

In one embodiment of the present invention, the control circuit further detects a peak value of a voltage signal of the AC power or the rectified power, and generates the second reference signal according to the peak value, the feedback-related signal and the first reference signal so that the upper limit is adaptively adjusted.

In one embodiment of the present invention, the control circuit further detects a peak value of a voltage signal of the AC power or the rectified power, and generates the second reference signal according to the peak value, the feedback-related signal, a duty ratio of the power switch and the first reference signal so that the upper limit is adaptively adjusted.

In one embodiment of the present invention, the control circuit further compares the feedback-related signal with a ramp signal to control an ON time of the power switch, wherein the ramp signal is obtained by charging a capacitor with a current signal, and the current signal is proportional to the square of a peak value of a voltage signal of the AC power or the rectified power.

In another perspective of the present invention, it provides a control circuit for a power factor correction circuit, the power factor correction circuit including an inductor coupled to rectified power obtained by rectifying AC power, and a power switch operating to control a current of the inductor (inductor current), wherein the control circuit controls the power switch and comprises: a first PWM signal generator generating a first PWM signal, wherein the first PWM signal is generated according to a ramp signal and a signal Comp relating to a feedback signal; a calculation circuit generating a reference signal Ref2 according to the signal Comp relating to the feedback signal and a voltage signal Vin relating to the AC power or to the rectified power, wherein Ref2=k*Comp/Vin and k is a constant; a current limiter circuit generating a chop signal, wherein the chop signal is generated according to the current sensing signal and the reference signal Ref2; and a switch operation circuit generating an operation signal to control the power switch according to the first PWM signal and the chop signal, wherein when the current sensing signal is not lower than the reference signal Ref2, the power switch is turned off so that the inductor current is kept not higher than the upper limit.

In one embodiment of the present invention, k is proportional to 1/D, wherein D is a duty ratio of the power switch.

In one embodiment of the present invention, k=k1*Ref1, wherein K1 is a constant and Ref1 is a reference signal having a predetermined value or a value set by a user.

In one embodiment of the present invention, the control circuit further comprises: a sample circuit generating a ratio signal according to the rectified power to represent a peak value of the voltage signal; a feed-forward circuit generating a square signal according to the ratio signal; a first voltage-to-current converter generating a current signal according to the square signal; and a first ramp signal generator generating a first ramp signal according to the current signal.

In one embodiment of the present invention, the calculation circuit includes: a first voltage-to-current converter converting the signal Comp relating to the feedback signal to a first current; a second voltage-to-current converter converting the reference signal Ref1 to a second current; a third voltage-to-current converter converting the voltage signal Vin to a third current; a multiplier/divider circuit multiplying the first current with the second current, and dividing their product by the third current, to generate a reference current; and a second current-to-voltage converter converting the reference current to the reference signal Ref2.

In one embodiment of the present invention, the calculation circuit includes: a first voltage-to-current converter converting one of the signal Comp relating to the feedback signal and the reference signal Ref1 to a first current; a second voltage-to-current converter converting the voltage signal Vin to a second current; a second ramp signal generator generating a second ramp signal, wherein the second ramp signal is generated according to the second current and a second PWM signal; a second PWM signal generator generating a second PWM signal, wherein the second PWM signal is generated according to the second ramp signal and the other one of the signal Comp relating to the feedback signal and the reference signal Ref1; a third ramp signal generator generating a third ramp signal, wherein the third ramp signal is generated according to the first current and the second PWM signal; and a peak value detector detecting a peak value of the third ramp signal, for generating the reference signal Ref2.

In another perspective of the present invention, it also provides a method for driving load circuit through power factor correction, comprising: receiving AC power and generating a rectified power; generating an inductor current according to the rectified power by an operation of a power switch, and generating a current sensing signal according to the inductor current; generating a feedback signal; generating a feedback-related signal relating to the feedback signal; obtaining a voltage signal relating to the AC power or the rectified power, and generating a reference signal to determine an upper limit of the inductor current according to the voltage signal and the feedback-related signal; and comparing the current sensing signal with the reference signal, wherein when the current sensing signal is not lower than the reference signal, the power switch is turned off so that the inductor current is kept not higher than the upper limit.

The objectives, technical details, features, and effects of the present invention will be better understood with regard to the detailed description of the embodiments below, with reference to the drawings.

DESCRIPTION OF THE PREFERRED EMBODIMENTS

Figure 1:
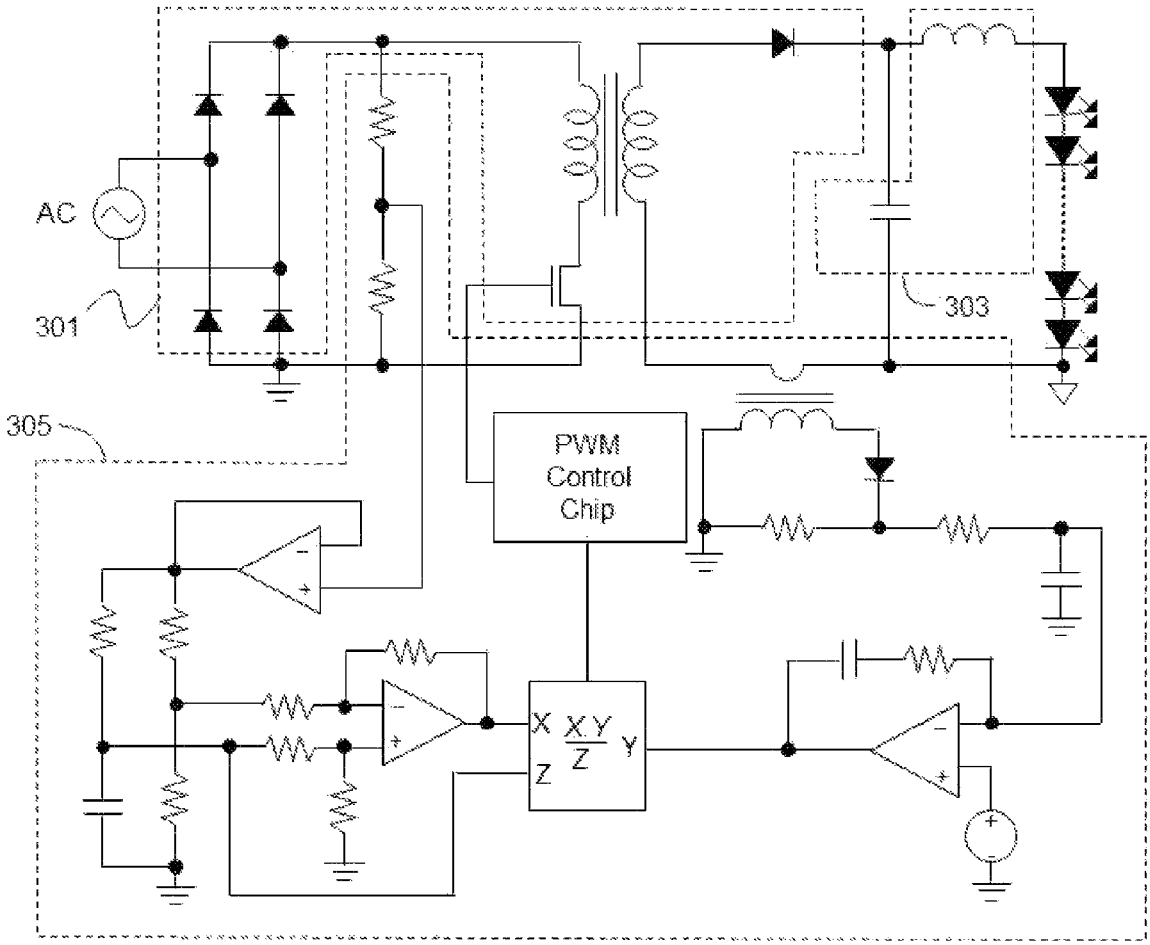
Fig. 1 (Prior Art)
FIG. 1 shows an LED driver circuit disclosed in US 2011/0037414.
Figure 2A:
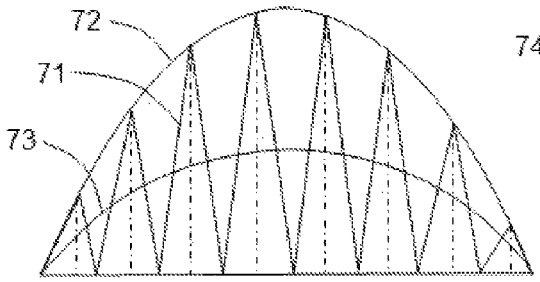
Fig. 2A (Prior Art)
FIG. 2A shows the waveform of an inductor current in a prior art PFC converter.
Figure 2B:
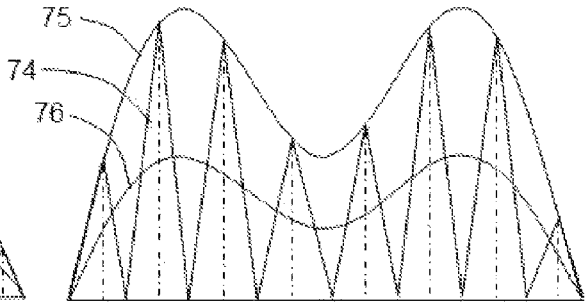
Fig. 2B (Prior Art)
FIG. 2B shows the waveform of an inductor current in a power factor correction circuit disclosed in US 2010/0014326.
Figure 3A:
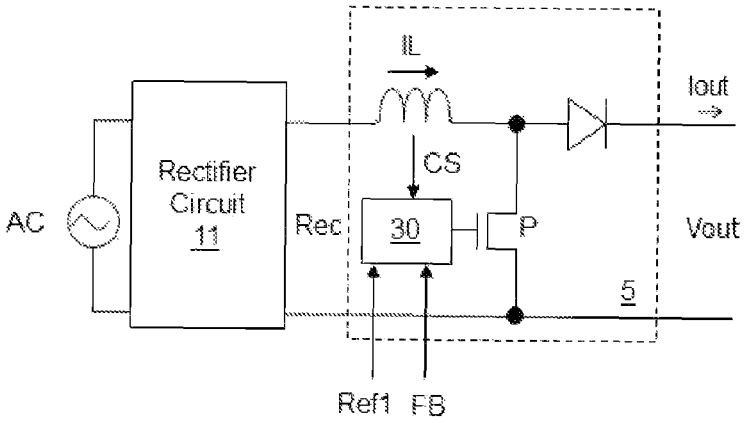
FIGS. 3A-3B show two application structures of the present invention, respectively.

FIG. 3A shows an application structure of the present invention, wherein a rectifier circuit 11 (for example but not limited to a bridge rectifier circuit) receives AC power and generates rectified power Rec. A power factor correction (PFC) circuit 5 converts the rectified power Rec to an output voltage Vout and supplies an output current Iout, wherein the output voltage Vout can be coupled to a load circuit, or to a primary side of a transformer. In the PFC circuit 5, a control circuit 30 generates an operation signal to control an operation switch P for power factor correction according to a feedback signal FB (which is for example a divided voltage of the output voltage Vout), a current sensing signal CS (which for example can be obtained by detecting an inductor current) and a first reference signal Ref1 (to be described later).

Figure 3B:
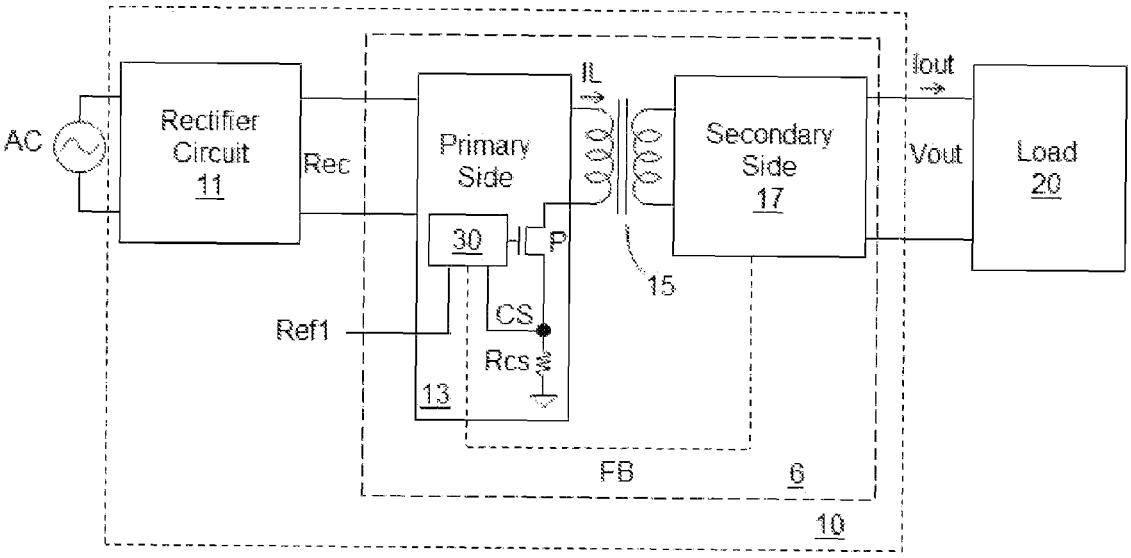

FIG. 3B shows another application structure, wherein an AC-to-DC converter 10 includes a rectifier circuit 11 (for example but not limited to a bridge rectifier circuit) receiving AC power and generating rectified power Rec. A flyback PFC circuit 6 converts the rectified power Rec to the output voltage Vout and supplies the output current Iout, wherein the output voltage Vout can be coupled to a load circuit 20. The flyback PFC circuit 6 includes: a primary side circuit 13 receiving the rectified power Rec, wherein the primary side circuit 13 has a power switch P operating to generate a primary side current IL according to the rectified power Rec, and a current sensing signal CS is generated according to the primary side current IL; a transformer 15 coupled with the primary side circuit 13, which converts the the primary side current IL to a secondary side current; and a secondary side circuit 17 coupled with the transformer 15, which receives the secondary side current to generate the output voltage Vout and to supply the output current Iout to the load circuit 20. The secondary side circuit 17 generates a feedback signal FB to feedback-control the primary side circuit 13. The primary side circuit 13 includes a control circuit 30 generating an operation signal for operating the power switch P to control the primary side current IL. The operation signal is generated according to the feedback signal FB, the current sensing signal CS and a first reference signal Ref1 (to be described later).

In the above two application structures, the present invention limits the inductor current IL (or the primary side current) to be not higher than an upper limit by means of a chop control method, to generate an inductor waveform shown in FIG. 10 (to be described later). By this way, a peak-to-average ratio (PAR) of the primary side current IL is reduced, so a capacitor with lower capacitance can be used to reduce cost and extend the life time of LEDs; also, a better power factor can be generated by keeping the voltage peak and current peak in corresponding phase. Besides, the present invention also can reduce the ripple of the output voltage Vout.

One characteristic of the present invention is that the chop control method is simpler than those methods disclosed in the prior art. Please refer to FIG. 4 for an embodiment of the control circuit 30 according to the present invention, wherein the control circuit 30 includes: a PWM signal generator 31, a calculation circuit 33, a current limiter circuit 35 and a switch operation circuit 37. The PWM signal generator 31 can be, for example but not limited to, a comparator shown in the figure, and it receives a first ramp signal Ramp1 and an error amplified signal Comp for comparing these two signals to generate a first PWM signal PWM1, wherein the error amplified signal Comp is a signal relating to the feedback signal; i.e., the feedback-related signal may be the feedback signal FB itself or an error amplified signal generated by comparing the feedback signal FB with a reference value. A basic function of the current limiter circuit 35 is to protect the circuit from being damaged by an over-current (i.e., a current that is too high). In general design, the current limiter circuit 35 receives the current sensing signal CS and compares it with an over-current protection limit, wherein when the current sensing signal CS is higher than the over-current protection limit, the current limiter circuit 35 sends a signal to the switch operation circuit 37, forcing the power switch P to be turned off. The present invention makes use of the current limiter circuit 35 in an inventive way; in this embodiment, the over-current protection limit of the current limiter circuit 35 is set to Ref2 (the second reference signal), which is obtained according to the error amplified signal Comp and the first reference signal Ref1 by calculation of the calculation circuit 33; the calculation circuit 33 may be, for example but not limited to, a multiplier/divider circuit (to be described later). The current limiter circuit 35 receives the current sensing signal CS and compares it with the second reference signal Ref2 to generate a chop signal (Chop), such that the power switch P is turned off when the current sensing signal CS is not lower than the second reference signal Ref2. In other words, an upper current limit can be set by setting the reference signal Ref1, and the inductor current IL (or the primary side current IL) can be kept not higher than the upper limit by the chop signal generated by the current limiter circuit 35. The switch operation circuit 37 receives the first PWM signal PWM1 and the chop signal to generate an operation signal OP for operating the power switch P, wherein when the inductor current IL is lower than the upper limit, the power switch P operates according to the first PWM signal PWM1, and when the inductor current IL reaches the upper limit, the power switch P stops operating according to the chop signal. By this way, the inductor current IL can be kept not higher than the upper limit, so the inductor waveform shown in FIG. 10 is generated.

In the above embodiment, the second reference signal Ref2 is set by setting the first reference signal Ref1; this is for allowing a user to set different chop ratios by assigning different values to the first reference signal Ref1. However, if it is not necessary to allow a user to set the chop ratio, the first reference signal Ref1 can be a predetermined constant. The same applies to all the following embodiments.

Another characteristic of the present invention is that the chop ratio can be adaptively adjusted in correspondence to the level (or amplitude) of input power (AC power or rectified power Rec), or in correspondence to the rating of the input power (for example, 265V or 95V). Please refer to FIG. 5 for another preferable embodiment of the control circuit 30. As shown in the figure, besides the PWM signal generator 31, the calculation circuit 33, the current limiter circuit 35 and the switch operation circuit 37, the control circuit 30 further includes a sample circuit 32, a feed-forward circuit 34, a voltage-to-current converter 36 and a ramp signal generator 38. The sample circuit 32 receives the rectified power Rec to generate a ratio signal MULT which is proportional to a voltage peak of rectified power Rec, i.e., assuming that the voltage peak is Vin, $$\text{MULT}=K*\text{Vin}, \text{ wherein } K \text{ is a constant.}$$

The feed-forward circuit 34 generates a square signal SQ relating to the square of the ratio signal MULT, that is, SQ is proportional to $K^2*\text{Vin}^2$. In the application structure in FIG. 3A, SQ is proportional to $K^2*\text{Vin}^2$; in the application structure in FIG. 3B, SQ is preferably proportional to $K^2*\text{Vin}^2*D$, wherein D is a duty ratio of the power switch P, that is, $D=1/[1+(\text{Vin}/n\text{Vout})]$, wherein n is a ratio of number of turns between the primary side winding and the secondary side winding. The voltage-to-current converter 36 converts the square signal SQ to a current signal. The ramp signal generator 38 can generate the first ramp signal Ramp1 by, for example but not limited to, a method shown in FIG. 5, wherein a clock signal CLK controls a switch so that a capacitor Cramp is charged by the current signal from the voltage-to-current converter 36 to generate the first ramp signal Ramp1. The calculation circuit 33 receives the error amplified signal Comp, the first reference signal Ref1, and the ratio signal MULT, and generates the second reference signal Ref2 accordingly. In this manner, the control circuit 30 can adaptively adjust the upper limit according to the rectified power Rec such that the upper limit of the inductor current IL is dependent on the level or amplitude of the AC power.

Figure 5:
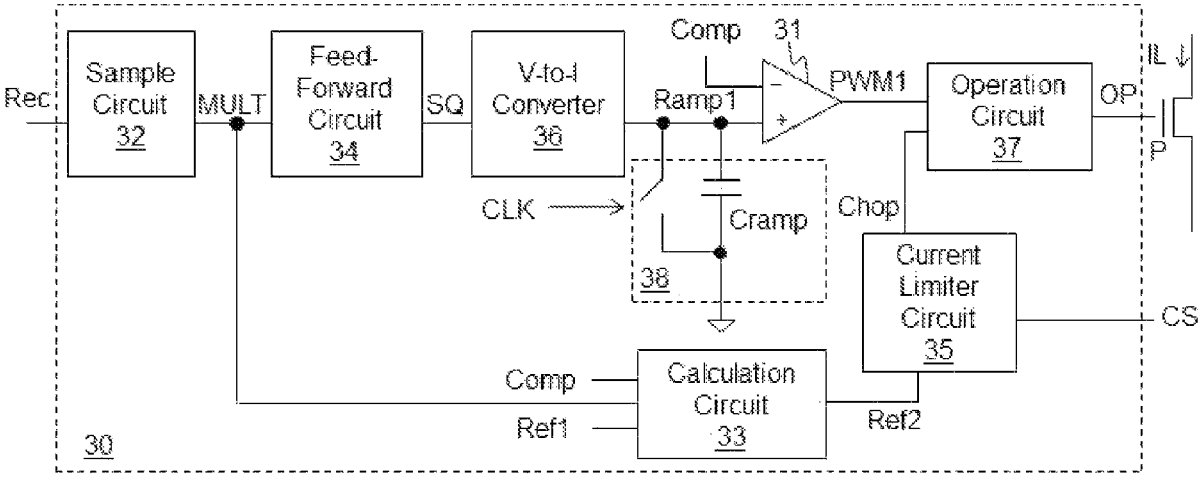
FIG. 5 shows a preferable embodiment of the control circuit 30 according to the present invention.

More specifically, assuming Ton being an on-time of the signal PWM1, according to FIG. 5, $$T\text{on}=(K1*\text{Cramp}*\text{Comp})/(K2*\text{Vin}^2*Gm),$$

wherein K1 is a constant and Gm is a conductance of the voltage-to-current converter 36.

In addition, according to power calculation formula, $$P\text{out}=\eta*Iavm*Vinm,$$

wherein Pout is output power, η is an efficiency constant, Iavm is a root-mean-square value of the current signal of the rectified power Rec, and Vinm is a root-mean-square value of the voltage signal of the rectified power Rec.

Assuming that the control circuit operates in a boundary control mode (BCM), then $$Iavm=Ipkm/2=(½)*(Vinm/L)*T\text{on},$$

wherein Ipkm is a current peak of the rectified power Rec and L is an inductance of the primary winding of the transformer 15. According to the formula of Pout and the formula of the on-time Ton, $$T\text{on}=K3*(\text{Cramp}*\text{Comp})/(\text{MULT}^2*Gm)=(2*L*P\text{out})/(\eta*Vinm)^2$$

wherein K3 is a constant. Comparing the two sides of the above formula, it can be understood that in order to fix the signal Comp for different levels of the input voltage (represented by Vinm), it is required for the feed-forward circuit 34 to cancel parameters relating to the input voltage in the formula. In addition, the feed-forward circuit 34 should preferably also be capable of fixing the error amplified signal Comp in a burst mode.

In addition, according to the formula of the on-time Ton and the relationship between the inductor voltage and the inductor current, it can be derived that $$Ipeak=(Vin/L)*Ton=K4*Comp/Vin$$

wherein Ipeak is a peak of the inductor current IL, that is, the upper limit, and K4 is a constant.

If SQ is proportional to K2*Vin$^2$*D as in the application structure in FIG. 3B, then Ipeak=K5*Comp/(Vin*D), wherein K5 is a constant.

Moreover, if a peak value of the current sensing signal CS is Vcs, then $$Ipeak*Rcs=Vcs$$

wherein Rcs is the resistance of the resistor Rcs shown in FIG. 3B, or a resistance of a sensing resistor (not shown) for sensing the inductor current in FIG. 3A. It can be understood from above that, under the condition that the capacitance of the capacitor Cramp and the inductance L of the primary winding are constant, if it is desired to chop the primary side current IL below an upper limit which is adaptively adjusted according to the input power AC, the peak Vcs of the current sensing signal CS has to be proportional to the quotient of the error amplifier Comp divided by the voltage peak Vin. In the application structure in FIG. 3B, it is even more preferable for the current sensing signal CS to be proportional to the quotient of the error amplified signal Comp divided by (the product of the voltage peak Vin and the duty ratio D of the power switch P). But certainly, if the duty ratio D of the power switch P is not taken into consideration in the application structure of FIG. 3B, it still provides improved effects and therefore still belongs to the scope of the present invention.

Figure 4:
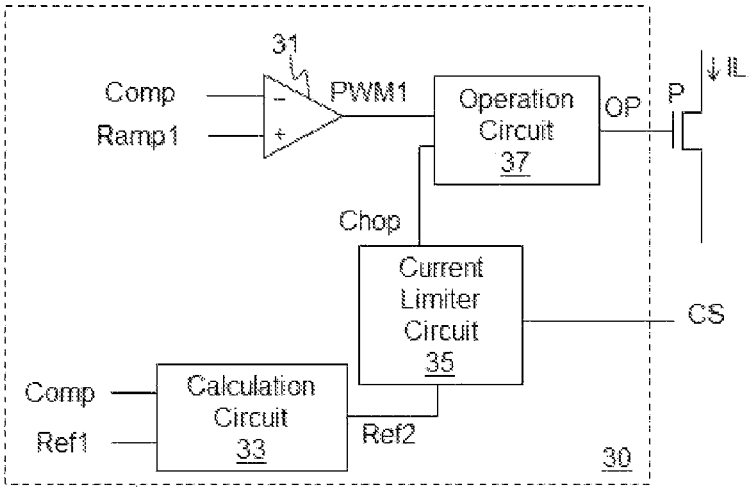
FIG. 4 shows an embodiment of a control circuit 30 according to the present invention.
Figure 6:
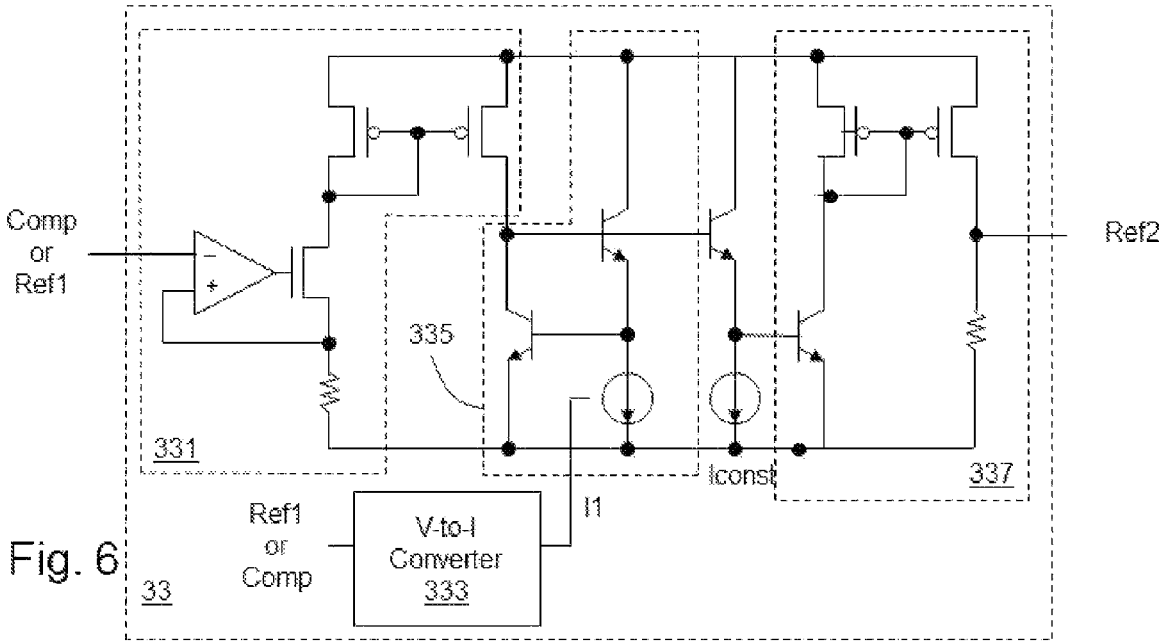
FIG. 6 shows a more specific embodiment of the calculation circuit 33 according to the present invention.

Next, please refer to FIG. 6 for a specific embodiment of the calculation circuit 33 according to the present invention, which can cooperate with the control circuit 30 in FIG. 4. As shown in FIG. 6, the calculation circuit 33 includes a voltage-to-current converter 331, a voltage-to-current converter 333, a multiplier 335 and a current-to-voltage converter 337. The voltage-to-current converter 331 converts one of the error amplified signal Comp and the first reference signal Ref1 to a current signal while the voltage-to-current converter 333 converts the other one of the error amplified signal Comp and the reference signal Ref1 (the one that is not an input of the voltage-to-current converter 331) to another current signal. The multiplier 335 multiplies the two current signals, and the current-to-voltage converter 337 converts the result of the multiplication to a voltage signal, that is, the second reference signal Ref2. Accordingly, Ref2 is proportional to Comp*Ref1, and Ref1 can be considered as a parameter settable by a user to determine the upper limit shown in the chop waveform of FIG. 10.

Figure 7:
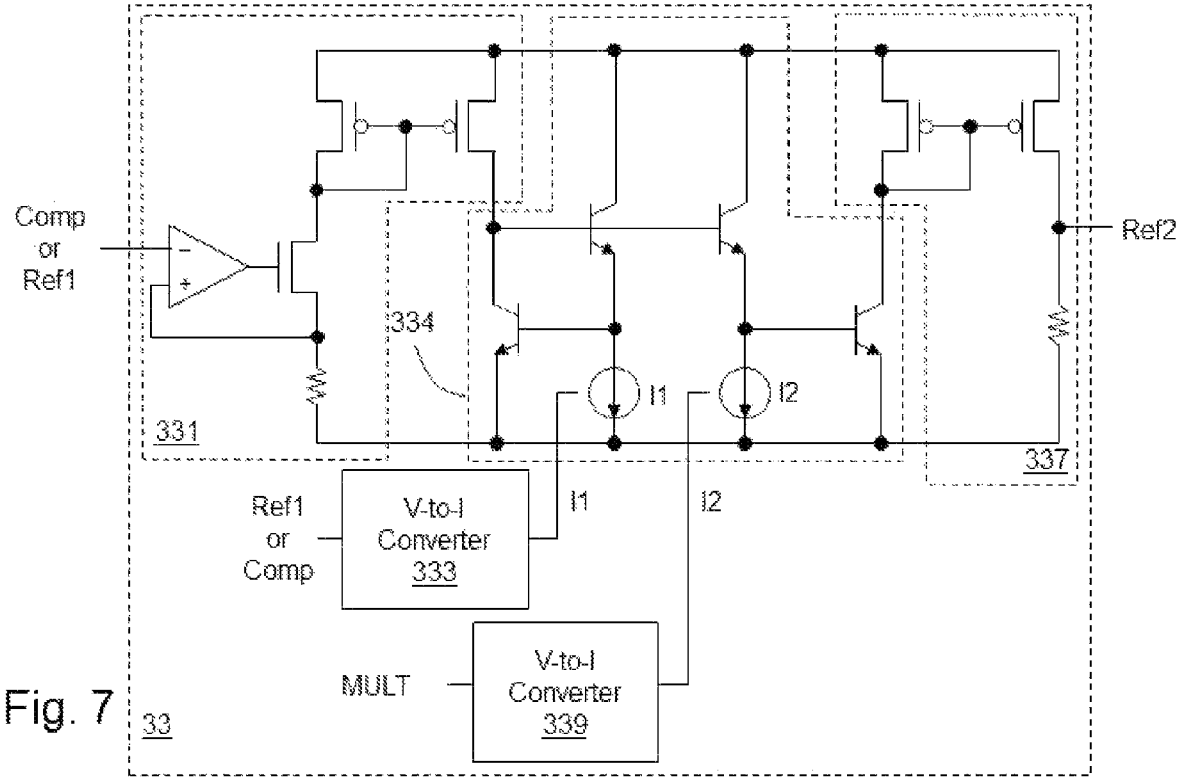
FIG. 7 shows another embodiment of the calculation circuit 33 according to the present invention.

Please refer to FIG. 7 for another specific embodiment of the calculation circuit 33 according to the present invention, which can cooperate with the control circuit 30 in FIG. 5. As shown in FIG. 7, the calculation circuit 33 includes a voltage-to-current converter 331, a voltage-to-current converter 333, a voltage-to-current converter 339, a multiplier/divider circuit 334 and a current-to-voltage converter 337. Compared with the embodiment shown in FIG. 6, besides the voltage-to-current converter 331 and the voltage-to-current converter 333, this embodiment further includes the voltage-to-current converter 339 which converts the ratio signal MULT to a current signal. The multiplier/divider circuit 334 multiplies the two current signals from the voltage-to-current converter 331 and the voltage-to-current converter 333, and dividing the product by the current signal generated by the voltage-to-current converter 339. The current-to-voltage converter 339 converts the result calculated by the multiplier/divider circuit 334 to a voltage signal, that is, the second reference signal Ref2. In this embodiment, Ref2 is proportional to Comp*Ref1/MULT, that is, proportional to Comp*Ref1/Vin, and Ref1 can be considered as a parameter settable by a user to determine the upper limit shown in the chop waveform of FIG. 10, wherein the upper limit can be adaptively adjusted according to the input power AC.

Figure 8:
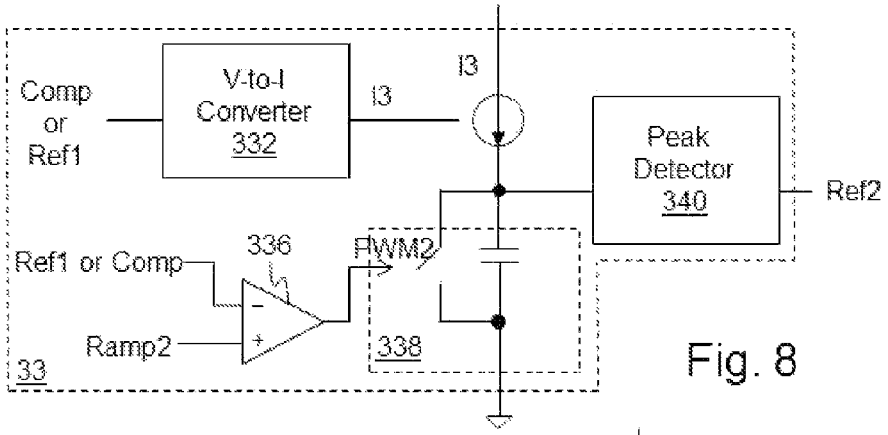
FIG. 8 shows another embodiment of the calculation circuit 33 according to the present invention.

Referring to FIG. 8 for another specific embodiment of the calculation circuit 33 according to the present invention, the calculation circuit 33 includes: a voltage-to-current converter 332, a comparator 336, a ramp signal generator 338 and a peak detector 340. In this embodiment, the voltage-to-current converter 332 converts one of the error amplified signal Comp and the first reference signal Ref1 to a current signal 13 while the comparator 336 generates a second PWM signal PWM2 by comparing the other one of the error amplified signal Comp and the first reference signal Ref1 (the one which is not an input of the voltage-to-current converter 332) with a second ramp signal Ramp2 to control a switch of the ramp signal generator 338. The current source generates a current which can be, for example but not limited to, equal to the current signal 13 generated by the voltage-to-current converter 332. The current signal 13 is processed by the ramp signal generator 338 to generate a ramp signal, and the peak detector 340 detects the peak of the ramp signal to generate a second reference signal Ref2, wherein Ref2 is proportional to Comp*Ref1. The circuit of FIG. 8 also can provide similar functionalities as the circuit of FIG. 6, and it can cooperate with the control circuit 30 in FIG. 4.

Figure 9:
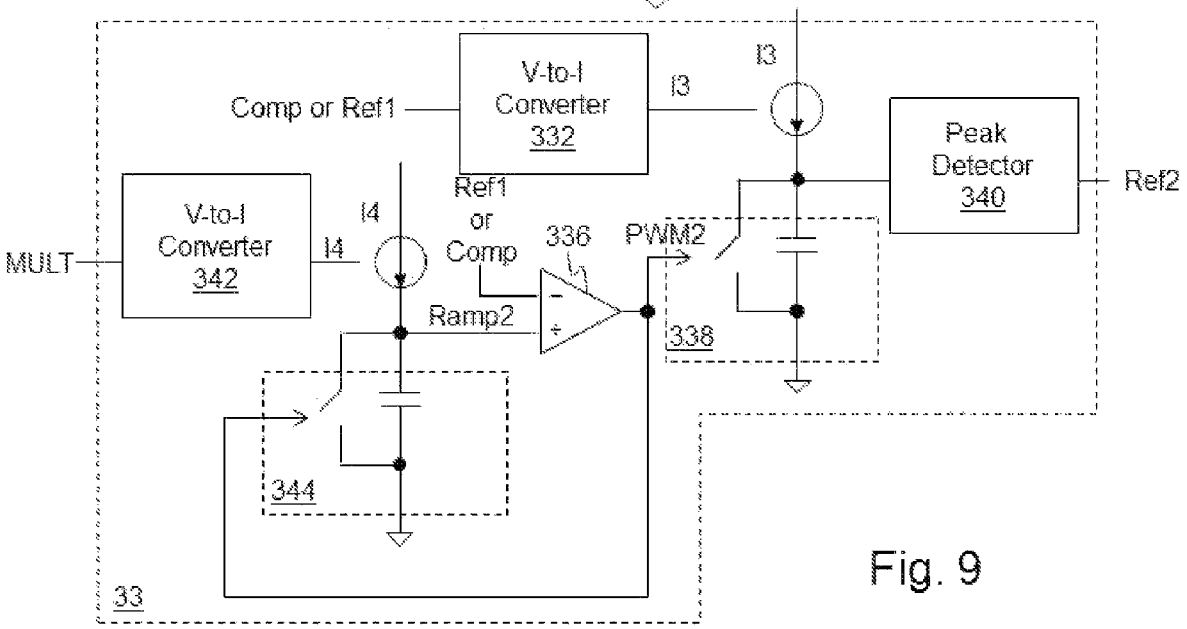
FIG. 9 shows another embodiment of the calculation circuit 33 according to the present invention.

Referring to FIG. 9 for another specific embodiment of the calculation circuit 33 according to the present invention, the calculation circuit 33 includes the voltage-to-current converter 332, the comparator 336, the ramp signal generator 338 and the peak detector 340 shown in FIG. 8, and it further includes another voltage-to-current converter 342 and another ramp signal generator 344. In this embodiment, the voltage-to-current converter 332 converts the ratio signal to a current signal 14, which is received by the ramp signal generator 344 to generate the second ramp signal Ramp2. Further, the second PWM signal PWM2 generated by the comparator 336 not only controls the switch of the ramp signal generator 338, but also feed-back controls the switch of the ramp signal generator 344. In this embodiment, Ref2 is proportional to Comp*Ref1. This embodiment also provides similar functionalities as the circuit in FIG. 7, and it can cooperate with the control circuit 30 in FIG. 5. The second reference signal Ref2 keeps the inductor current not higher than the upper limit, and the upper limit can be adaptively adjusted according to the input power AC.

If the present invention is applied to the structure in FIG. 3B, it can be arranged for the ratio signal MULT to be proportional to Vin*D in the above embodiments, so that Ref2 can be proportional to Comp*Ref1/(Vin*D) to achieve a more precise control. However, as mentioned above, in the structure in FIG. 3B, even if Ref2 is not proportional to Comp*Ref1/(Vin*D) but only proportional to Comp*Ref1/Vin, it can still achieve the major purposes of the present invention.

Furthermore, in the above embodiments, if it is not required for a user to set the value of the first reference signal Ref1, then Ref2 is only required to be proportional to Comp (Ref2=k*Comp) for the above embodiments to cooperate with the control circuit 30 in FIG. 4, or Ref2 is only required to be proportional to Comp/Vin (Ref2=k*Comp/Vin) for the above embodiments to cooperate with the control circuit 30 in FIG. 5. If the above embodiments are to cooperate with the structure in FIG. 3B, Ref2 shall be proportional to Comp/(Vin*D), that is, k shall be proportional to 1/D.

Figure 10:
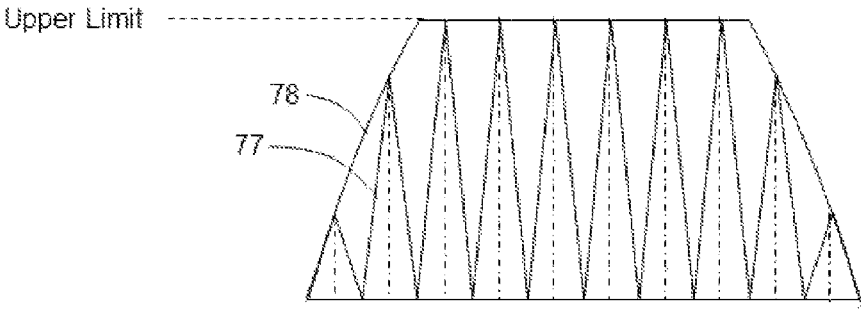
FIG. 10 shows the waveform of an inductor current IL in the present invention.

FIG. 10 shows that the inductor current IL generated in the present invention has an inductor current signal waveform 77 and an envelope signal waveform 78, wherein the inductor current IL is limited to be not higher than the upper limit. In this way, the PAR of the inductor current IL is reduced, so it can avoid using an electrolytic capacitor with high capacitance, and it can reduce the cost and extend the life time of LEDs. In addition, the present invention provides better power factor because the current peak and voltage are in phase.

Figure 11A:
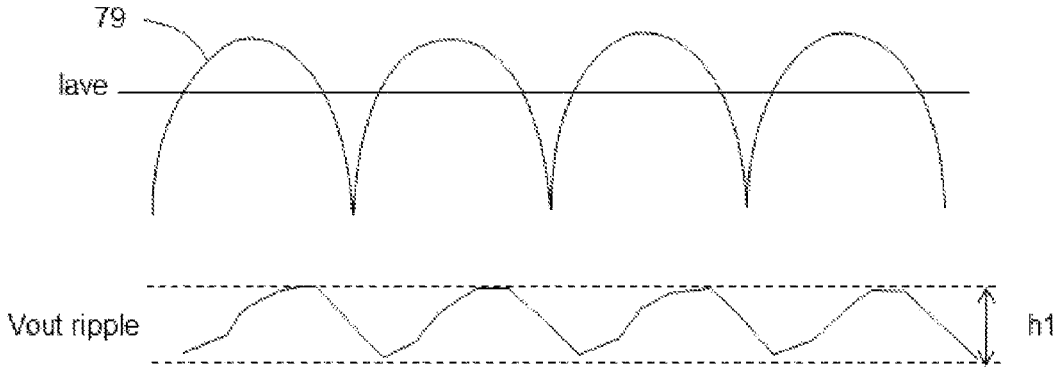
Fig. 11A (Prior Art)
FIGS. 11A and 11B show comparisons between the inductor current envelopes 79 and 78 and the ripples in the output voltage Vout according to prior art and the present invention, respectively.
Figure 11B:
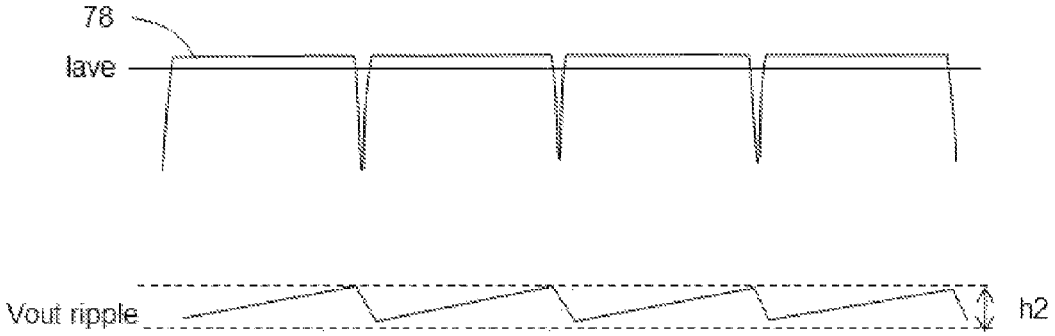

FIGS. 11A and 11B show an inductor current envelope 79 generated by the power factor correction circuit in the prior art and an inductor current envelope 78 generated according to present invention, respectively. Under the same average current Iave, the output voltage Vout generated by the power factor correction circuit in the prior art has a ripple h1 as shown in FIG. 11A; the output voltage Vout generated by the power factor correction circuit of the present invention has a ripple h2 as shown in FIG. 11B, wherein h2<h1, that is, the present invention can provide more stable output voltage Vout with smaller ripple.

The present invention has been described in considerable detail with reference to certain preferred embodiments thereof. It should be understood that the description is for illustrative purpose, not for limiting the scope of the present invention. Those skilled in this art can readily conceive variations and modifications within the spirit of the present invention. For example, the ratio signal MULT is not limited to be obtained from the rectified power Rec, but can be obtained, for example, from the AC power. As another example, the foregoing embodiments use the voltage peak Vin of the rectified power Rec for calculation, but any other voltage signal relating to the AC power or the rectified power Rec can be used for calculation instead of the voltage peak; for instance, an average value or an average value multiplied by a proper ratio can be used instead. As another example, the ramp signal Ramp1 in FIG. 4 also can be generated by a circuit as shown in FIG. 5. As another example, a device which does not affect the primary functions of the circuits can be interposed between two devices or circuits shown to be in direct connection in the illustrated embodiments, such as other switches. As yet another example, the positive and negative input terminals of a comparator can be interchanged as long as corresponding modifications are made so that the input and output signals of the comparator are properly processed to provide a desired function. Thus, the present invention should cover all such and other modifications and variations, which should be interpreted to fall within the scope of the following claims and their equivalents.

What is claimed is:

1. A power factor correction circuit receiving rectified power obtained by rectifying AC power and correcting the power factor of the rectified power, the power factor correction circuit comprising:

an inductor coupled to the rectified power;

a power switch operating to control a current of the inductor (inductor current); and a control circuit generating a feedback-related signal according to a feedback signal, and generating an operation signal to control the power switch according to the feedback-related signal, a current sensing signal relating to the inductor current, and a first reference signal, wherein the control circuit generates a second reference signal according to the first reference signal to determine an upper limit of the inductor current, and the control circuit compares the current sensing signal with the second reference signal; when the current sensing signal is not lower than the second reference signal, the power switch is turned off so that the inductor current is kept not higher than the upper limit;

wherein the control circuit includes:

a sample circuit generating a ratio signal according to the rectified power;

a feed-forward circuit generating a square signal according to the ratio signal;

a voltage-to-current converter generating a current signal according to the square signal;

a first ramp signal generator generating a first ramp signal according to the current signal;

a first PWM signal generator generating a PWM signal, wherein the PWM signal is generated according to the first ramp signal and the feedback-related signal;

a calculation circuit multiplying the feedback-related signal with the first reference signal to generate the second reference signal;

a current limiter circuit generating a chop signal, wherein the chop signal is generated according to the current sensing signal and the second reference signal; and a switch operation circuit generating the operation signal according to the PWM signal and the chop signal, wherein the operation signal controls the power switch to keep the inductor current not higher than the upper limit.

2. The power factor correction circuit of claim 1, wherein the calculation circuit includes:

a first voltage-to-current converter converting the feedback-related signal to a first current;

a second voltage-to-current converter converting the first reference signal to a second current;

a third voltage-to-current converter converting the ratio signal to a third current;

a multiplier/divider circuit multiplying the first current with the second current, and dividing their product by the third current, to generate a reference current; and a second current-to-voltage converter converting the reference current to the second reference signal.

3. The power factor correction circuit of claim 1, wherein the calculation circuit includes:

a first voltage-to-current converter converting one of the feedback-related and the first reference signal to a first current;

a second voltage-to-current converter converting the ratio signal to a ratio current;

a second ramp signal generator generating a second ramp signal, wherein the second ramp signal is generated according to the ratio current and a second PWM signal;

a second PWM signal generator generating the second PWM signal, wherein the second PWM signal is generated according to the second ramp signal and the other one of the feedback-related signal and first reference signal;

a third ramp signal generator generating a third ramp signal, wherein the third ramp signal is generated according to the first current and the second PWM signal; and a peak value detector detecting a peak value of the third ramp signal and generating the second reference signal.

4. A control circuit for a power factor correction circuit, the power factor correction circuit including an inductor coupled to rectified power obtained by rectifying AC power, and a power switch operating to control a current of the inductor (inductor current), wherein the control circuit controls the power switch and comprises:

a first PWM signal generator generating a first PWM signal, wherein the first PWM signal is generated according to a ramp signal and a signal Comp relating to a feedback signal;

a calculation circuit generating a reference signal Ref2 according to the signal Comp relating to the feedback signal and a voltage signal Vin relating to the AC power or to the rectified power, wherein Ref2=k*Comp/Vin and k is a constant;

a current limiter circuit generating a chop signal, wherein the chop signal is generated according to the current sensing signal and the reference signal Ref2; and a switch operation circuit generating an operation signal to control the power switch according to the first PWM signal and the chop signal, wherein when the current sensing signal is not lower than the reference signal Ref2, the power switch is turned off so that the inductor current is kept not higher than the upper limit.

5. The control circuit of claim 4, further comprising:

a sample circuit generating a ratio signal according to the rectified power, wherein the ratio signal represents a peak value of the voltage signal Vin;

a feed-forward circuit generating a square signal according to the ratio signal;

a first voltage-to-current converter generating a current signal according to the square signal; and a first ramp signal generator generating a first ramp signal according to the current signal.

6. The control circuit of claim 4, wherein k is proportional to 1/D, wherein D is a duty ratio of the power switch.

7. The control circuit of claim 4, wherein k=k1*Ref1, wherein K1 is a constant and Ref1 is a reference signal having a predetermined value or a value set by a user.

8. The control circuit of claim 7, wherein the calculation circuit includes:

a first voltage-to-current converter converting the signal Comp relating to the feedback signal to a first current;

a second voltage-to-current converter converting the reference signal Ref1 to a second current;

a third voltage-to-current converter converting the voltage signal Vin to a third current;

a multiplier/divider circuit multiplying the first current with the second current, and dividing their product by the third current, to generate a reference current; and a second current-to-voltage converter converting the reference current to the reference signal Ref2.

9. The control circuit of claim 7, wherein the calculation circuit includes:

a first voltage-to-current converter converting one of the signal Comp relating to the feedback signal and the reference signal Ref1 to a first current;

a second voltage-to-current converter converting the voltage signal Vin to a second current;

a second ramp signal generator generating a second ramp signal, wherein the second ramp signal is generated according to the second current and a second PWM signal;

a second PWM signal generator generating a second PWM signal, wherein the second PWM signal is generated according to the second ramp signal and the other one of the signal Comp relating to the feedback signal and the reference signal Ref1;

a third ramp signal generator generating a third ramp signal, wherein the third ramp signal is generated according to the first current and the second PWM signal; and a peak value detector detecting a peak value of the third ramp signal, for generating the reference signal Ref2.

10. A method for driving a load circuit through power factor correction, comprising:

receiving AC power and generating a rectified power;

generating an inductor current according to the rectified power by an operation of a power switch, and generating a current sensing signal according to the inductor current;

generating a feedback signal;

generating a feedback-related signal relating to the feedback signal;

obtaining a voltage signal relating to the AC power or the rectified power, and generating a reference signal to determine an upper limit of the inductor current according to the voltage signal and the feedback-related signal; and comparing the current sensing signal with the reference signal, wherein when the current sensing signal is not lower than the reference signal, the power switch is turned off so that the inductor current is kept not higher than the upper limit;

wherein the step of generating a reference signal generates the reference signal according to the relationship: Ref2=k*Comp/Vin, wherein Ref2 is the reference signal, k is a constant, Comp is the signal relating to the feedback signal, and Vin is a voltage signal relating to the AC power or the rectified power.

11. The method of claim 10, wherein k is proportional to 1/D, wherein D is a duty ratio of the power switch.

12. The method of claim 10, wherein k=k1*Ref1, wherein K1 is a constant and Ref1 is a reference signal having a predetermined value or a value set by a user.

* * * * *